United States Patent [19]

Blanchard

[11] 4,406,634

[45] Sep. 27, 1983

[54] OUTBOARD MOTOR WITH STEERING ARM LOCATED AFT OF TRANSOM AND BELOW TILT AXIS

[75] Inventor: Clarence E. Blanchard, Kenosha, Wis.

[73] Assignee: Outboard Marine Corporation, Waukegan, Ill.

[21] Appl. No.: 189,143

[22] Filed: Sep. 22, 1980

Related U.S. Application Data

[63] Continuation-in-part of Ser. No. 167,337, Jul. 9, 1980.

[51] Int. Cl.[3] ..... B63H 21/26

[52] U.S. Cl. ..... 440/61; 248/642

[58] Field of Search ..... 440/58–63, 440/55, 56; 248/640, 641, 642, 643

[56] References Cited

U.S. PATENT DOCUMENTS 871,459 11/1907 Thorsen ..... 248/643
2,138,600 11/1938 Harmon ..... 248/641
3,648,645 3/1972 Ezell ..... 440/63
3,774,571 11/1973 Shimanckas ..... 440/55
4,177,747 12/1979 Pichl ..... 248/642

*Primary Examiner*—Sherman D. Basinger
*Attorney, Agent, or Firm*—Michael, Best & Friedrich

[57] ABSTRACT

Disclosed herein is an outboard motor comprising transom bracket adapted to be fixed to the transom of a boat, a propulsion unit supporting a thrust producing element, and a bracket assembly connecting the propulsion unit to the transom bracket so as to provide for pivotal steering movement of the propulsion unit relative to the transom bracket and for tilting of the propulsion unit relative to the transom bracket about a tilt axis located rearwardly of the transom, which bracket assembly connecting the propulsion unit to the transom bracket includes a steering arm connected to the propulsion unit and extending forwardly therefrom below the tilt axis and having a forward end terminating rearwardly of the transom.

16 Claims, 3 Drawing Figures

OUTBOARD MOTOR WITH STEERING ARM LOCATED AFT OF TRANSOM AND BELOW TILT AXIS

RELATED APPLICATIONS

This application is a continuation-in-part of my earlier copending application Ser. No. 167,337 filed July 9, 1980.

Attention is also directed to the copending Myron T. Stevens application entitled "Outboard Motor With Elevated Horizontal Pivot Axis", Ser. No. 159,480, filed June 16, 1980 now U.S. Pat. No. 4,355,986.

Attention is also directed to the copending Hall et al application entitled "Marine Propulsion Device Steering Mechanism", Ser. No. 173,158 filed July 28, 1980 now U.S. Pat. No. 4,373,920.

BACKGROUND OF THE INVENTION

The invention relates generally to marine propulsion devices and, more particularly, to outboard motors including a propulsion unit which includes an internal combustion engine and which is both steerable and tiltable.

More particularly, the invention relates to outboard motors which can be mounted on a relatively high, flush transom and which, when tilted to a raised position providing out-of-the-water accessibility to the propeller, do not travel substantially forwardly of the rear surface of the boat transom.

SUMMARY OF THE INVENTION

The invention provides an outboard motor comprising a transom bracket adapted to be fixed to the transom of a boat, a propulsion unit supporting a thrust producing element, and means connecting the propulsion unit to the transom bracket so as to provide for pivotal steering movement of the propulsion unit relative to the transom bracket and for tilting of the propulsion unit relative to the transom bracket about a tilt axis located rearwardly of the transom. The means connecting the propulsion unit to the transom bracket includes a steering arm which is connected to the propulsion unit and which extends forwardly therefrom below the tilt axis and/or has a forward end terminating rearwardly of the transom.

In one embodiment of the invention, the means connecting the propulsion unit to the transom bracket includes a swivel bracket, means pivotally connecting the transom bracket and the swivel bracket for tilting movement of the swivel bracket relative to the transom bracket about an upper horizontal axis, and means pivotally connecting the propulsion unit to the swivel bracket for steering movement of the swivel bracket relative to the propulsion unit, which moves pivotally connecting the swivel bracket and the propulsion unit includes a king pin received in the swivel bracket, connected to the propulsion unit for steering movement thereof in response to pivotal movement of the king pin, and having the steering arm fixed thereto.

In one embodiment of the invention, the means connecting said propulsion unit to the transom bracket further includes a stern bracket pivotally connected to the transom bracket about the upper horizontal axis and pivotally connected to the swivel bracket for trimming movement of the swivel bracket relative to the stern bracket about a lower horizontal axis.

In one embodiment of the invention, the outboard motor further includes means connected to the stern bracket for pivotally displacing the stern bracket relative to the transom bracket about the upper horizontal axis and means connected to the swivel bracket for adjustable locating the swivel bracket relative to the stern bracket about the lower horizontal axis.

In one embodiment of the invention, the king pin includes an upper end and the steering arm is fixed to the upper end of the king pin.

Other features and advantages of the embodiments of the invention will become known by reference to the following general description, claims and appended drawings.

IN THE DRAWINGS

Figure 1:
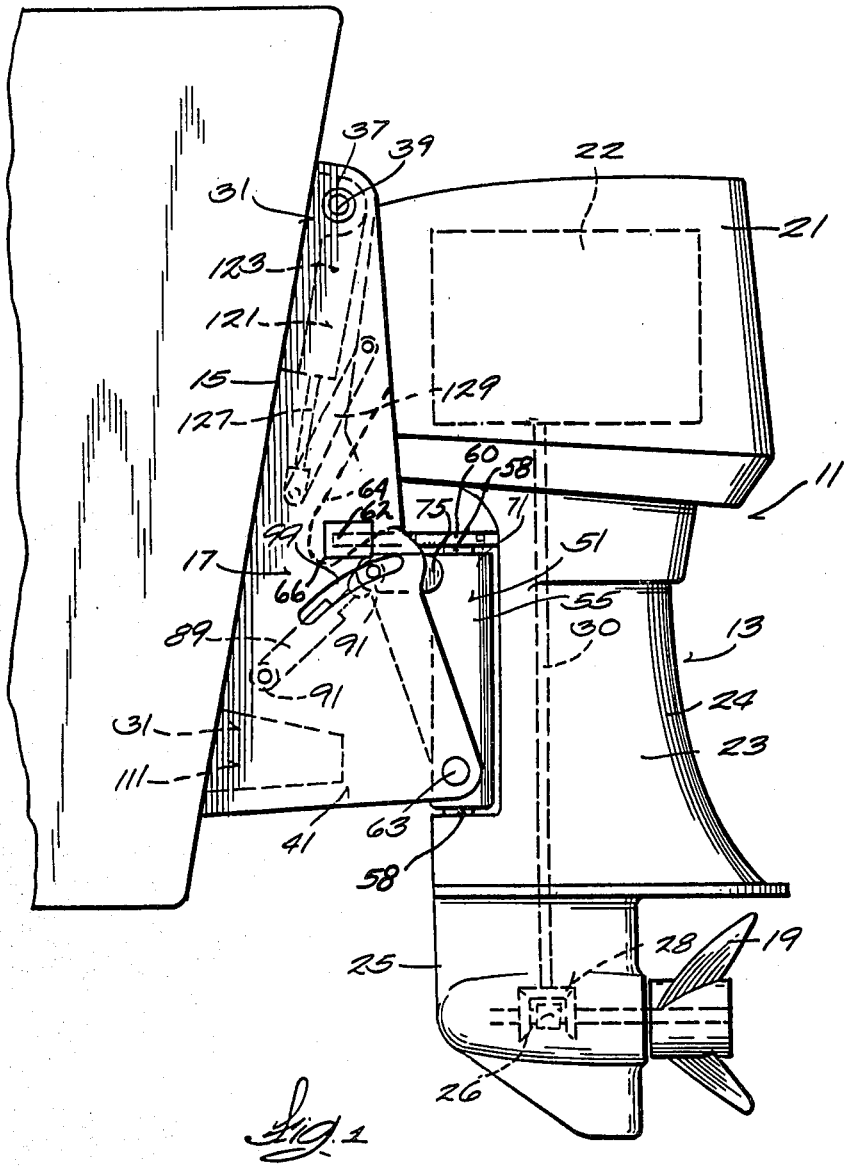
FIG. 1 is a fragmentary side elevational view of one embodiment of an outboard motor including various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device which is in the form of an outboard motor 11 including a tiltable and steerable propulsion unit 13 including a rotatably mounted propeller 19. The outboard motor 11 also includes means 17 for mounting the propulsion unit on a boat transom 15 so as, as will be explained more fully hereinafter, to permit tilting of the propulsion unit 13 from a normal running position with the propeller 19 submerged in water to a raised tilted position providing above water accessibility to the propeller 19 without causing any substantial movement of the propulsion unit 13 forwardly of the rear of the boat transom 15, and to permit propulsion unit steering movements.

As is conventional, the propulsion unit 13 includes a powerhead 21 provided with an internal combustion engine 22, together with a lower unit 23 which is fixed to the bottom of the powerhead 21 and which includes a drive shaft housing 24 and a lower gear case or box 25 which supports a propeller shaft 26 carrying the propeller 19. The gear box 25 includes a suitable transmission 28 which connects the propeller shaft 26 to a drive shaft 30 which, in turn, is connected to the crankshaft of the internal combustion engine 22.

The means 17 for mounting the propulsion unit 13 for tiltable and swinging movement comprises transom bracket means 31 (see also FIG. 2) which is adapted to be fixed to the boat transom 15 and which can constitute a unitary member, or an assemblage of members, or separate pieces individually fixed to the rear surface of the boat transom 15 by any suitable means. The transom bracket means 31 includes a horizontally disposed enlargement 33 which is located rearwardly of the boat transom 15 and which includes a horizontal bore 35.

Pivotally connected to the enlargement 35 as by a pivot pin 37 extending through the bore 35, or by any other suitable means, is the upper end of a stern bracket 41 which is accordingly tiltable relative to the boat transom 15 in a vertical plane about an upper horizontal axis 39 between a normal running position in which the stern bracket 41 engages the boat transom 15 for transmitting thereto propulsive thrust and a raised tilt position. The stern bracket 41 extends downwardly from the pivotal connection and can be of U-shape in horizontal cross-section including a laterally spaced pair of wing portions 43 connected by a laterally and vertically extending strengthening portion or web 45. If desired, a horizontally extending strengthening shelf 47 can extend between the wing portions 43 adjacent to the lower end thereof and preferably somewhat above the extreme lower end thereof.

As illustrated, the wing portions 43, at their lower ends, extend rearwardly to a considerably greater extent than at their upper ends with the rearward extent progressively diminishing from lower ends toward the upper ends.

The propulsion unit mounting means or arrangement 17 also includes a swivel bracket 51 including a vertical leg 53 having upper and lower ends 55 and 57, respectively, and a vertical bore 59 extending therebetween.

The propulsion unit mounting means or arrangement 17 also includes a king pin 58 which extends through the bore 59 of the swivel bracket 51 and is preferably connected above and below the swivel bracket 51 with the drive shaft housing 24 of the lower unit 23 so that pivotal movement of the king pin 58 causes corresponding pivotal steering movement of the propulsion unit 13. In addition, the king pin 58 has rigidly attached to the upper end thereof a steering arm 60 which projects forwardly from the king pin 58 and connected propulsion unit 13 at a level well below the tilt axis 39 and which includes a forward end 62 terminating rearwardly of the transom 15. Any suitable means shown schematically at 66 in FIG. 1 can be connected to the forward end 62 of the steering arm 60 for effecting pivotal steering movement of the king pin 58 and connected propulsion unit 13. One particularly desirably arrangement is disclosed in copending application Ser. No. 173,158, filed July 28, 1980 and incorporated herein by reference.

If desired, the central area of the wing portions 43 of the stern bracket 41 can be modified as shown at 64 in dotted outline in FIG. 1 to provide accessability to the forward end of the steering arm 60.

The propulsion unit mounting means or arrangement 17 further includes means 61 connecting the swivel bracket 51 to the stern bracket 41 for swinging movement of the swivel bracket 51 relative to the stern bracket 41 in a vertical plane about a lower horizontal axis 63. While various arrangements can be employed, in the construction illustrated in FIG. 1, such means comprises a pair of aligned bores 65 respectively extending in the lower rearward part of the laterally spaced wing portions 43 of the stern bracket 41, together with a pair of bosses 67 located between the wing portions 43 and extending oppositely from the lower end 57 of the vertical swivel bracket leg 53 and including threaded bores in alignment with the bores 65 in the wing portions 43, and suitable pivot means, such as threaded pins 69 (one shown) extending through the wing portion bores 65 and threaded into the bores in the bosses 67.

The propulsion unit mounting means or arrangement 17 also includes means for pivotally displacing the swivel bracket 51 about the lower horizontal axis 63 so as to enable trimming of the propulsion unit 13 into the proper position to maximize propulsion efficiency. While various arrangements can be employed, in the construction illustrated in FIG. 1, such means comprises an arm 71 projecting forwardly from the upper end 55 of the swivel bracket 51 between the wing portions 43, which arm 71 includes, at the forward end thereof, a bifurcated portion having spaced fingers 75 and aligned transverse bores 77 extending through the fingers 75.

The means for pivotally displacing the swivel bracket 51 also includes a hydraulic cylinder-piston 89 assembly including, at the opposite ends thereof, suitable eye structures 91. One of the eye structures 91 of the cylinder-piston assembly 89 is pivotally connected, by any suitable means, to the laterally spaced wing portions 43 of the stern bracket 41. For instance, a hinge pin 93 extending through the eye structure 91 and fixed at its ends in the wing portions 43, can be employed.

The other eye structure 91 of the cylinder-piston assembly 89 is pivotally connected, by any suitable means, to the bifurcated forward part of the swivel bracket 51. For instance, a hinge pin 95 extending through the eye structure 91 and through the previously mentioned aligned bores 77, can be employed. In order to provide guidance for the path of the hinge pin 95 during extension and retraction of the cylinder-piston assembly 89, the hinge pin 95 can include ends 97 (one shown) guided in respective arcuate slots 99 provided in the laterally spaced wing portions 43 and extending about a common uniform radius from the lower horizontal axis 63.

Accordingly, extension and retraction of the cylinder-piston assembly 89 can be employed to vary the trim angle of the swivel bracket 51 and connected propulsion unit 13 about the lower horizontal axis 63 to obtain maximum propulsion efficiency.

The propulsion unit mounting means or arrangement 17 also includes means 111 for absorbing any side pressures which may be applied to the stern bracket 41. While various arrangements can be employed, in the illustrated construction, such means comprises a U-shaped bracket 113 which can be unitary with the aforementioned transom bracket means 31 or which can be separately mounted on the boat transom 15.

The bracket 113 includes two laterally spaced arms 115 which extend rearwardly below the lower edge of the stern bracket web 45 and below the horizontal strengthening shelf 47 and in inwardly adjacent relation to the inner surfaces of the stern bracket wing portions 43 for transmission thereto from the wing portions 43 of side loading from the stern bracket 41 without adversely affecting pivotal movement of the stern bracket 41 about its pivot in the absence of such loading.

The propulsion unit mounting means or arrangement 17 also includes means 121 for tilting the stern bracket relative to the transom bracket means 31 about the upper horizontal axis 39 so as to displace the propulsion unit 13 from the normal operating position to a raised tilt position providing above water accessibility to the propeller 19.

While various arrangements can be employed, in the illustrated construction, a tilt linkage is provided, which tilt linkage includes a tilt cylinder 123 which is fixedly mounted on, and forms a part of, the transom bracket means 31, which extends in generally parallel relation to the boat transom 15, and which includes a piston rod 127 which, at one end, is pivotally connected, by any suitable means, to a push link 129 which, at its opposite ends, is pivotally connected, by any suitable means, to the wing portions 43 of the stern bracket 41. In the disclosed construction, the upper end of the link 129 is yoke shaped with two arms 131 which are respectively pivotally connected, as by one or more studs 133, to the wing portions 43. As the tilt cylinder is contracted, movement of the piston rod 127 tilts or pushes the stern bracket 41 and the accompanying propulsion unit 13 upwardly to the elevated or raised tilt position. Such upward tilting does not disturb the trim setting of the swivel bracket 51 and propulsion unit 13 relative to the stern bracket 41 and, upon repositioning of the stern bracket 41 in engagement with the boat transom 15, the trim setting of the propulsion unit will remain the same.

Propulsive thrust from the propulsion unit 13 is carried into the stern bracket 41 through the connection of the propulsion unit 13 with the swivel bracket 41 and through the connection of the swivel bracket 51 with the lower end of the stern bracket 41 and through the trim cylinder assembly 89 to the stern bracket 41. From the stern bracket 41, propulsive force is transmitted to the boat transom 15 by reason of engagement of the relatively elongated vertical forward edges 141 of the stern bracket 41 and web 45 against the flat rearward surface of the boat transom 15.

Figure 3:
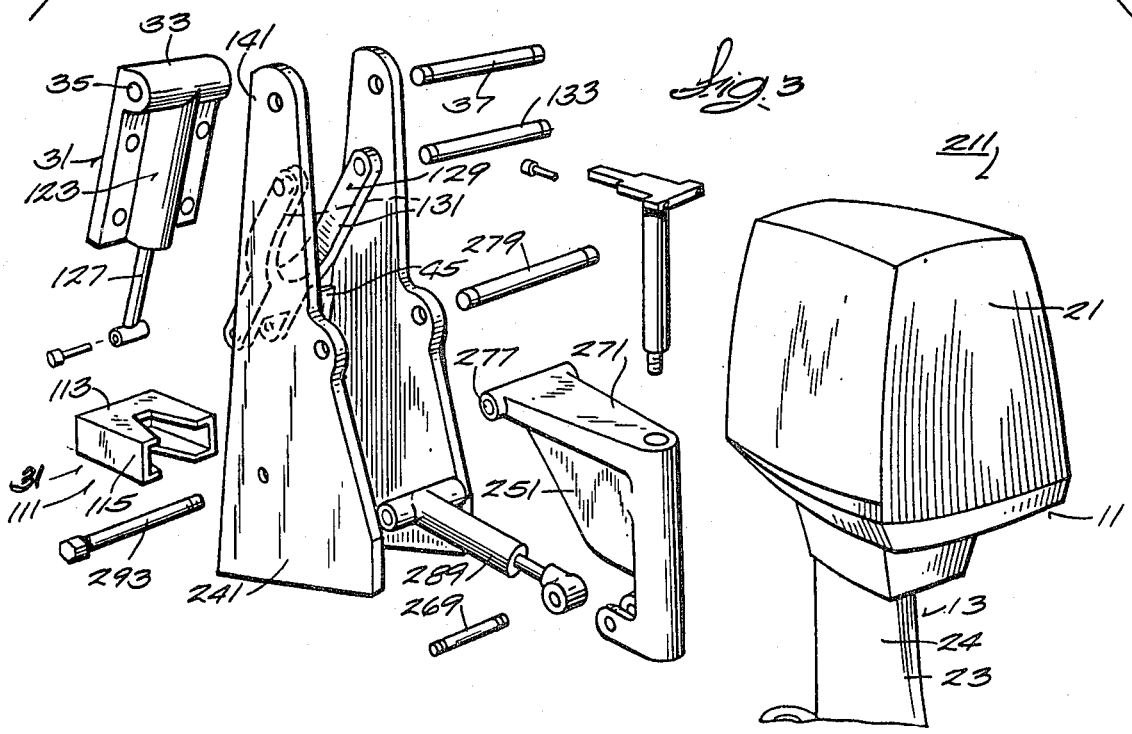
FIG. 3 is an exploded perspective view of another embodiment of an outboard motor including various of the features of the invention.

Shown in FIG. 3 is another embodiment of a marine propulsion device in the form of an outboard motor 211 which is similar to the outboard motor 11 shown in FIG. 1, except that the mounting of the swivel bracket 251 to the stern bracket 241 is reversed. More specifically, the upper end of the swivel bracket 251 includes a forwardly extending arm 271 having therein a transverse bore 277. Extending in the bore 277 is a pivot pin 279 which has its ends supported in the spaced wing portions 243 of the stern bracket 251 so as to provide tilting movement of the swivel bracket 251 in a vertical plane relative to the stern bracket 241.

Figure 2:
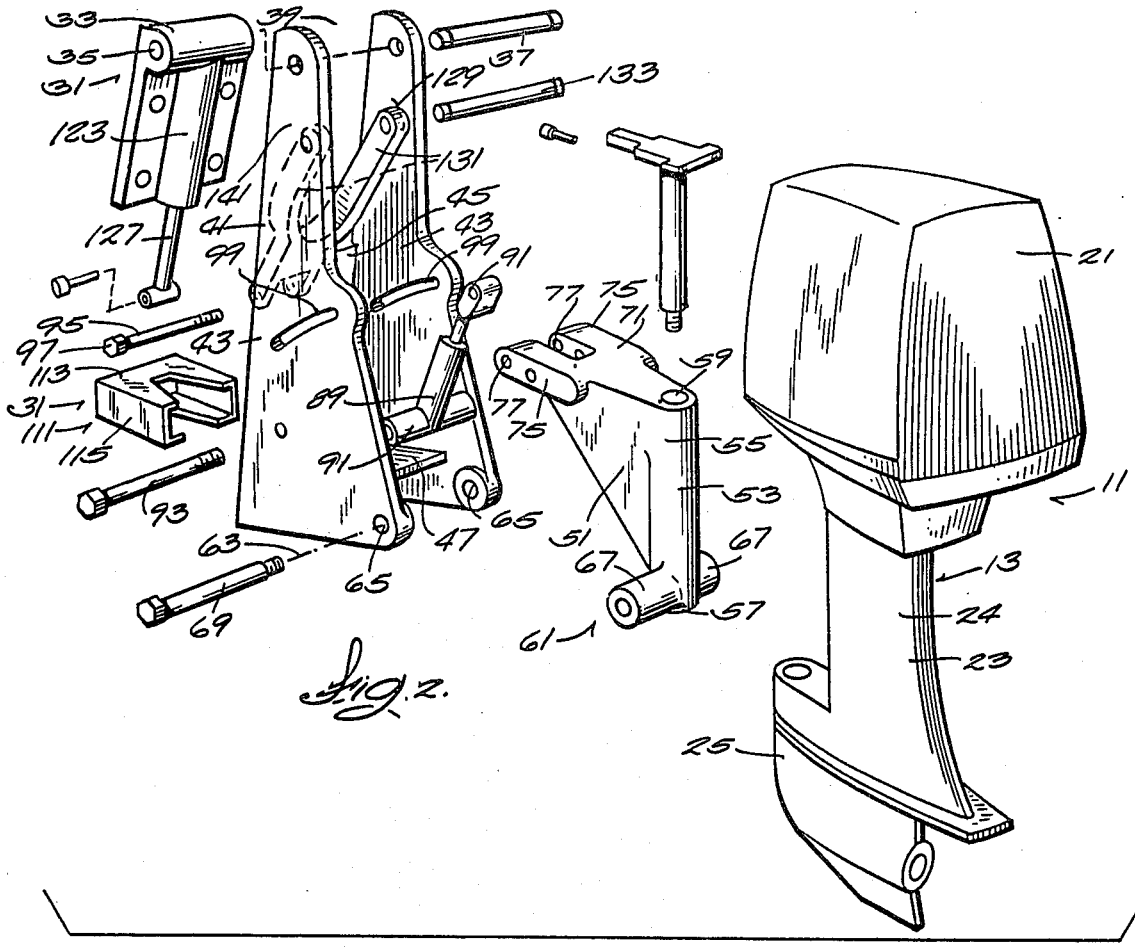
FIG. 2 is an exploded perspective view of the outboard motor shown in FIG. 1.

At its lower end, the swivel bracket 251 includes a pivotal connection, such as a pin 269, to a trim cylinder assembly 289 which, at its forward end, is pivotally connected, by any suitable means, such as the hinge pin 293, to the laterally spaced wing portions 243 of the stern bracket 241. In other respects, the arrangement shown in FIG. 2 is similar to the arrangement shown in FIG. 1.

The disclosed construction provides an arrangement for utilizing a standard outboard propulsion unit so as to provide accessibility to the propeller, but without causing the propulsion unit to move substantially forwardly of the transom. In addition, the propulsion unit can be trimmed to provide optimum propulsion efficiency independently of tilting operation. Still further in addition, the arrangement for steering can be located principally aft the boat as compared to forwardly of the transom.

Various of the features of the invention are set forth in the following claims.

I claim:

1. And outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom, and for pivotal steering movement of said propulsion unit relative to said transom bracket means about an axis transverse to the horizontal, said connecting means including a stern bracket pivotally connected to said transom bracket means about a first horizontal axis, and a unitary swivel bracket pivotally connected to said stern bracket about a second horizontal axis such that said second horizontal axis passes through said swivel bracket and through said stern bracket and such that said swivel bracket only pivots relative to said stern bracket about said second axis, and said swivel bracket being pivotally connected to said propulsion unit about said steering axis such that said propulsion unit only pivots relative to said swivel bracket about said steering axis, and a steering arm connected to said propulsion unit and extending forwardly therefrom below said first horizontal axis and having a forward end terminating rearwardly of the transom.

2. An outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom, and for providing pivotal steering movement of said propulsion unit relative to said transom bracket means about an axis transverse to the horizontal, said connecting means including a stern bracket pivotally connected to said transom bracket means about a first horizontal axis, and a unitary swivel bracket pivotally connected to said stern bracket about a second horizontal axis such that said second horizontal axis passes through said swivel bracket and through said stern bracket and such that said swivel bracket only pivots relative to said stern bracket about said second axis, and said swivel bracket being pivotally connected to said propulsion unit about said steering axis such that said propulsion unit only pivots relative to said swivel bracket about said steering axis, and a steering arm connected to said propulsion unit and having a forward end terminating rearwardly of the transom.

3. An outboard motor comprising transom bracket means adapted to be fixed to a boat transom, a propulsion unit supporting a thrust producing element, means connecting said propulsion unit to said transom bracket means so as to provide for vertical swinging of said propulsion unit rearwardly of the transom, and for pivotal steering movement of said propulsion unit relative to said transom bracket means about an axis transverse to the horizontal, said connecting means including a stern bracket pivotally connected to said transom bracket means about a first horizontal axis, and a unitary swivel bracket pivotally connected to said stern bracket about a second horizontal axis such that said second horizontal axis passes through said swivel bracket and through said stern bracket and such that said swivel bracket only pivots relative to said stern bracket about said second axis and said swivel bracket being pivotally connected to said propulsion unit about said steering axis such that said propulsion unit only pivots relative to said swivel bracket about said steering axis, and a steering arm connected to said propulsion unit and extending forwardly therefrom below said first horizontal axis.

4. An outboard motor in accordance with any of claims 1, 2 and 3 wherein said swivel bracket and said propulsion unit are pivotally connected by means including a king pin received in said swivel bracket, connected to said propulsion unit for steering movement thereof in response to pivotal movement of said king pin, and having said steering arm fixed thereto.

5. An outboard motor in accordance with claim 4 and further including means connected to said stern bracket for pivotally displacing said stern bracket relative to said transom bracket means about said first horizontal axis and means connected to said swivel bracket for adjustably locating said swivel bracket relative to said stern bracket about said second horizontal axis.

6. An outboard motor in accordance with claim 4 wherein said king pin includes an upper end and wherein said steering arm is fixed to said upper end of said king pin.

7. An outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom, and for pivotal steering movement of said propulsion unit relative to said transom bracket means about an axis transverse to the horizontal, said connecting means including a stern bracket pivotally connected to said transom bracket means about a first horizontal axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about a second horizontal axis such that said second horizontal axis passes through said forward end of said first leg of said second bracket and through said stern bracket and such that said swivel bracket only pivots relative to said stern bracket about said second axis, and said second leg of said swivel bracket being pivotally connected to said propulsion unit about said steering axis such that said propulsion unit only pivots relative to said swivel bracket about said steering axis, and a steering arm connected to said propulsion unit and extending forwardly therefrom substantially below said first horizontal axis.

8. An outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom, and for pivotal steering movement of said propulsion unit relative to said transom bracket means about an axis transverse to the horizontal, said connecting means including a stern bracket pivotally connected to said transom bracket means about a first horizontal axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about a second horizontal axis such that said second horizontal axis passes through said forward end of said first leg of said swivel bracket and through said stern bracket and such that said swivel bracket only pivots relative to said stern bracket about said second axis, and said second leg of said swivel bracket being pivotally connected to said propulsion unit about said steering axis such that said propulsion unit only pivots relative to said swivel bracket about said steering axis, and a steering arm connected to said propulsion unit and extending forwardly therefrom and having a forward end terminating rearwardly of the transom.

9. An outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom and for pivotal steering movement of said propulsion unit relative to said transom bracket, said connecting means including a stern bracket pivotally connected to said transom bracket means about a first horizontal axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about a second horizontal axes such that said second horizontal axis passes through said forward end of said first leg of said swivel bracket and through said stern bracket and such that said swivel bracket only pivots relative to said stern bracket about said second axis, and said second leg of said swivel bracket being pivotally connected to said propulsion unit about said steering axis such that said propulsion unit only pivots relative to said swivel bracket about said steering axis, and a steering arm connected to said propulsion unit and extending forwardly therefrom between said horizontal axes and having a forward end terminating rearwardly of the transom.

10. An outboard motor comprising transom bracket means adapted to be fixed to a boat transom, a propulsion unit supporting a thrust producing element, means connecting said propulsion unit to said transom bracket means so as to provide for vertical swinging of said propulsion unit relative to said transom bracket means rearwardly of the transom, and for pivotal steering movement of said propulsion unit relative to said transom bracket means about an axis transverse to the horizontal, said connecting means including a stern bracket pivotally connected to said transom bracket means about a first horizontal axis, and a swivel bracket having first leg extending fore-and-aft with a forward end and a rearward end and having a second leg extending generally vertically from said rearward end of said first leg, said forward end of said swivel bracket first leg being pivotally connected to said stern bracket about a second horizontal axis such that said second horizontal axis passes through said forward end of said first leg of said swivel bracket and through said stern bracket and such that said swivel bracket only pivots relative to said stern bracket about said second axis, and said second leg of said swivel bracket being pivotally connected to said propulsion unit about said steering axis such that said propulsion unit only pivots relative to said swivel bracket about said steering axis, a steering arm connecting to said propulsion unit and extending forwardly therefrom below said first horizontal axis and having a forward end terminating rearwardly of the transom, and means adapted to be located rearwardly of the transom and connected to said steering arm forward end for effecting steering movement of said propulsion unit.

11. An outboard motor comprising transom bracket means adapted to be fixed to a boat transom, a propulsion unit including a powerhead and a lower unit connected to said powerhead and supporting a thrust producing element, means connecting said propulsion unit to said transom bracket means so as to provide for vertical swinging of said propulsion unit relative to said transom bracket means rearwardly of the transom and for pivotal steering movement of said propulsion unit relative to said transom bracket means about an axis transverse to the horizontal, said connecting means including a stern bracket pivotally connected to said transom bracket means about a first horizontal axis, and a swivel bracket having a first leg extending fore-and-aft with a forward end and a rearward end and having a second leg extending generally vertically from said rearward end of said first leg, said forward end of said swivel bracket first leg being pivotally connected to said stern bracket about a second horizontal axis such that said second horizontal axis passes through said forward end of said first leg of said swivel bracket and through said stern bracket and such that said swivel bracket only pivots relative to said stern bracket about said second axis, and said second leg of said swivel bracket being pivotally connected to said propulsion unit about said steering axis such that said propulsion unit only pivots relative to said swivel bracket about said steering axis, and a steering arm connected to said propulsion unit and extending forwardly therefrom below said first horizontal axis and having a forward end terminating rearwardly of the transom.

12. An outboard motor comprising transom bracket means adapted to be fixed to the transom of a boat, a member pivotally connected to said transom bracket means for swinging movement of said member relative to said transom bracket means about a first horizontal axis, a swivel bracket having a first leg extending fore-and-aft with a forward end and a rearward end and having a second leg extending generally vertically from said rearward end of said first leg, said forward end of said swivel bracket first leg being pivotally connected to said member for swinging movement relative to said member about a second horizontal axis which passes through said forward end of said swivel bracket first leg and through said member and which is located in spaced relation to said first horizontal axis and such that said swivel bracket is only pivotal relative to said member about said second horizontal axis, a propulsion unit supporting a thrust producing element and being pivotally connected to said second leg of said swivel bracket about a steering axis transverse to said horizontal axes, and such that said propulsion unit is only pivotal relative to said swivel bracket about said steering axis, and a steering arm extending forwardly from said propulsion unit between said first and second horizontal axes.

13. An outboard motor comprising transom bracket means adapted to be fixed to the transom of a boat, a member pivotally connected to said transom bracket means for swinging movement of said member relative to said transom bracket means about a first horizontal axis, said member having a lower end, a swivel bracket pivotally connected to said member for swinging movement relative to said member about a second horizontal axis located in spaced relation to said first horizontal axis and such that said swivel bracket is only pivotal relative to said member about said second horizontal axis, a propulsion unit suupporting a thrust producing element and being pivotally connected to said swivel bracket about a steering axis transverse to said horizontal axes and such that said propulsion unit is only pivotal relative to said swivel bracket about said steering axis, a steering arm extending forwardly from said propulsion unit between said first and second horizontal axes, and means on said transom bracket means and on said member lower end for engagement therebetween so as to enable transmission of side forces from said lower end of said member to said transom bracket means.

14. An outboard motor comprising transom bracket means adapted to be fixed to the transom of a boat, a member pivotally connected to said transom bracket means for swinging movement of said member relative to said transom bracket means about a first horizontal axis, a unitary swivel bracket pivotally connected to said member for swinging movement relative to said member about a second horizontal axis which passes through said swivel bracket and through said member and which is located in spaced relation to said first horizontal axis and above said lower end of said member and such that said swivel bracket is only pivotal relative to said member about said second horizontal axis, a propulsion unit supporting a thrust producing element and being pivotally connected to said swivel bracket about a steering axis transverse to said horizontal axes and such that said propulsion unit is only pivotal relative to said swivel bracket about said steering axis, and a steering arm extending forwardly from said propulsion unit between said first and second horizontal axes.

15. An outboard motor comprising transom bracket means adapted to be fixed to the transom of a boat, a member pivotally connected to said transom bracket means for swinging movement of said member relative to said transom bracket means about a first horizontal axis, a unitary swivel bracket pivotally connected to said member for swinging movement relative to said member about a second horizontal axis which passes through said swivel bracket and through said member and which is located in spaced relation to said first horizontal axis and such that said swivel bracket is only pivotal relative to said member about said second horizontal aixs, a propulsion unit including a thrust producing element, said propulsion unit being pivotally connected to said swivel bracket about a steering axis which is transverse to said horizontal axes and such that said propulsion unit is only pivotal relative to said swivel bracket about said steering axis, a first hydraulic cylinder piston assembly extending between and connecting said transom bracket means and said member for controlling pivotal movement therebetween, a second hydraulic cylinder piston assembly extending between and connecting said member and said swivel bracket for controlling pivotal movement therebetween and for transmitting propulsion thrust from said swivel bracket to said member, and a steering arm extending forwardly from said propulsion unit between said first and second horizontal axes.

16. An outboard motor comprising transom bracket means adapted to be fixed to the transom of a boat, a member pivotally connected to said transom bracket means for swinging movement of said member relative to said transom bracket means about a first horizontal axis, a swivel bracket having a first leg extending fore-and-aft with a forward end and a rearward end and having a second leg extending generally vertically from said rearward end of said first leg, said forward end of said swivel bracket first leg being pivotally conntected to said member for swinging movement relative to said member about a second horizontal axis which passes through said forward end of said swivel bracket first leg and through said member and which is located in spaced relation to said first horizontal axis and such that said swivel bracket is only pivotal relative to said member about said second horizontal axis, a propulsion unit including a thrust producing element, said propulsion unit being pivotally connected to said second leg of said swivel bracket about a steering axis which is transverse to said horizontal axes and such that said propulsion unit is only pivotal relative to said swivel bracket about said steering axis, a first hydraulic cylinder piston assembly extending between and connecting said transom bracket means and said member for controlling pivotal movement therebetween, a second hydraulic cylinder piston assembly extending between and connecting said member and said swivel bracket for controlling pivotal movement therebetween, and a steering arm extending forwardly from said propulsion unit between said first and second horizontal axes.

* * * * *